US007026998B2

(12) United States Patent
Chang et al.

(10) Patent No.: US 7,026,998 B2
(45) Date of Patent: Apr. 11, 2006

(54) STACKED MICROSTRIP REFLECT ARRAY ANTENNA

(75) Inventors: The-Nan Chang, Taipei (TW); Hong-Ru Su, Taipei (TW)

(73) Assignee: Tatung Co., Ltd., (TW)

( * ) Notice: Subject to any disclaimer, the term of this patent is extended or adjusted under 35 U.S.C. 154(b) by 0 days.

(21) Appl. No.: 10/867,776

(22) Filed: Jun. 16, 2004

(65) Prior Publication Data

US 2005/0122266 A1 Jun. 9, 2005

(30) Foreign Application Priority Data

Dec. 3, 2003 (TW) ..... 92221317 U

(51) Int. Cl.
*H01Q 1/38* (2006.01)

(52) U.S. Cl. ..... 343/700 MS; 343/912

(58) Field of Classification Search ..... 343/700 MS, 343/840, 912

See application file for complete search history.

(56) References Cited

U.S. PATENT DOCUMENTS 6,091,365 A * 7/2000 Derneryd et al. .... 343/700 MS
6,195,047 B1 * 2/2001 Richards ..... 343/700 MS
6,861,987 B1 * 3/2005 Chang et al. ..... 343/700 MS

* cited by examiner

*Primary Examiner*—Tan Ho
(74) *Attorney, Agent, or Firm*—Bacon & Thomas, PLLC

(57) ABSTRACT

A stacked microstrip reflect array antenna includes a circular disk for reflecting a remote communication signal; an antenna for receiving the communication signal reflected by the circular disk and sending another communication signal to the circular disk to be reflected; and a fixing frame for fixing the antenna on a first plane of the circular disk; wherein the first plane has a plurality of array squares, every array square has a plurality of first array elements and a second array element, the plurality of first array elements are mounted on a top surface of the first plane and the second array element is mounted on a bottom surface of the first plane at a position corresponding to a center of the plurality of first array elements.

10 Claims, 5 Drawing Sheets

STACKED MICROSTRIP REFLECT ARRAY ANTENNA

BACKGROUND OF THE INVENTION

1. Field of the Invention

The present invention relates to a reflect array antenna and, more particularly, to a stacked microstrip reflect array antenna.

2. Description of the Related Art

In the field of high frequency communications, in order to provide better communication bandwidth, a reflect array antenna is employed to receive and send signals. As shown in FIG. 1, U.S. Pat. No. 6,195,047/B1, entitled "Integrated microelectromechanical phase shifting reflect array antenna", discloses a microstrip phase shifting reflect array antenna 10 which includes a substantially flat circular disk 12 upon which a plurality of array elements 14 are disposed in a regular and repeating pattern. As shown in FIG. 1, array elements 14 are arranged in rows and columns on the disk 12. A feed horn 16 is located above the disk 12, either offset (as shown) or centered, over the plurality of array elements 14. Array elements 14 are placed on an upper surface of a thicker flat panel 18. Due to the special design of the array elements 14, a signal can be reflected to the feed horn 16; therefore, a relative position between the horn 16 and the disk 12 is fixed. When the reflect array antenna 10 receives a remote communication signal, the plurality of array elements 14 on the disk 12 reflect and focus the communication signal to the horn 16, so the horn 16 receives the communication signal with a better signal gain and a wider bandwidth. Furthermore, the reflect array antenna 10 can use the horn 16 to transmit another communication signal via the disk 12.

In order to obtain better signal gain and a wider bandwidth, the patterns of the array elements 14 are not identical. As shown in FIG. 2, all of the array element 141, the array element 142 and the array element 144 have a delay line with different lengths, while an array element 143 has no delay line. The delay lines are used for adjusting a phase of the communication signal to determine a main beam direction that the array element is to reflect, so that the communication signal reflected by the array element can be focused onto the horn 16. A user can rotate the array elements 14 so they have different angles. Alternatively, as shown in FIG. 3, an array element 145 has different delay lines (including a linear delay line 1451 and a curved delay line 1452) and is rotated for better signal gain and a wider bandwidth.

However, the prior art shifting reflect array antenna 10 has some drawbacks, such as a relatively limited signal gain, a narrow bandwidth and proper delay line arrangement to avoid cross-polarization.

Therefore, it is desirable to provide a stacked microstrip reflect array antenna to mitigate and/or obviate the aforementioned problems.

SUMMARY OF THE INVENTION

An objective of the present invention is to provide a stacked microstrip reflect array antenna which can provide a wider bandwidth.

Another objective of the present invention is to provide a stacked microstrip reflect array antenna which can avoid increasing the amount of cross-polarization.

Another objective of the present invention is to provide a stacked microstrip reflect array antenna which can reduce the quantity of delay lines.

Another objective of the present invention is to provide a stacked microstrip reflect array antenna which can increase the efficiency of the delay lines.

To achieve these objectives, the stacked microstrip reflect array antenna of the present invention includes a circular disk for reflecting a remote communication signal; an antenna for receiving the communication signal reflected by the circular disk and sending another communication signal to the circular disk to be reflected; and a fixing frame for fixing the antenna on a first plane of the circular disk; wherein the first plane comprises a plurality of array squares, every array square comprises a plurality of first array elements and a second array element, the plurality of first array elements are mounted on a top surface of the first plane and the second array element is mounted on a bottom surface of the first plane at a position corresponding to a center of the plurality of first array elements.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
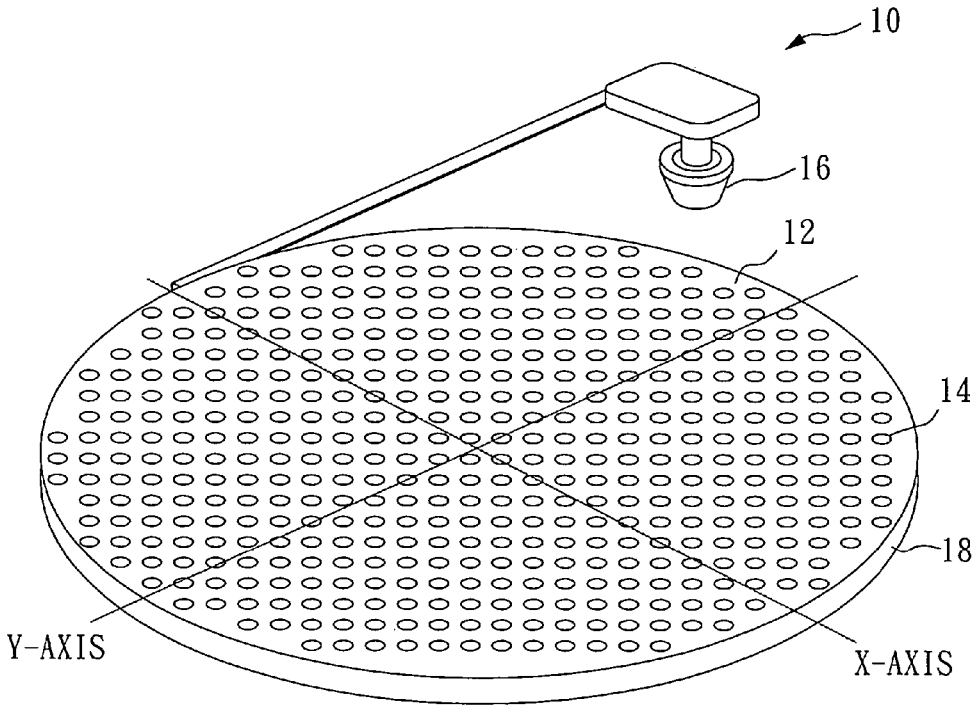
FIG. 1(PRIOR ART)
FIG. 1 is a schematic drawing of a prior art reflect array antenna.
Figure 2:
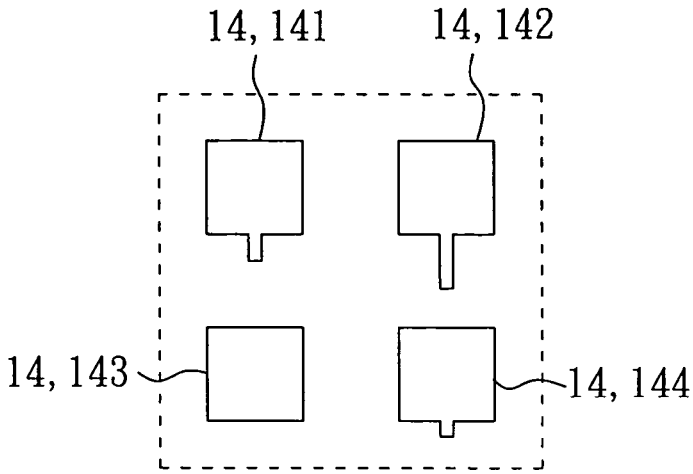
FIG. 2(PRIOR ART)
FIG. 2 is a schematic drawing of a plurality of array elements.
Figure 3:
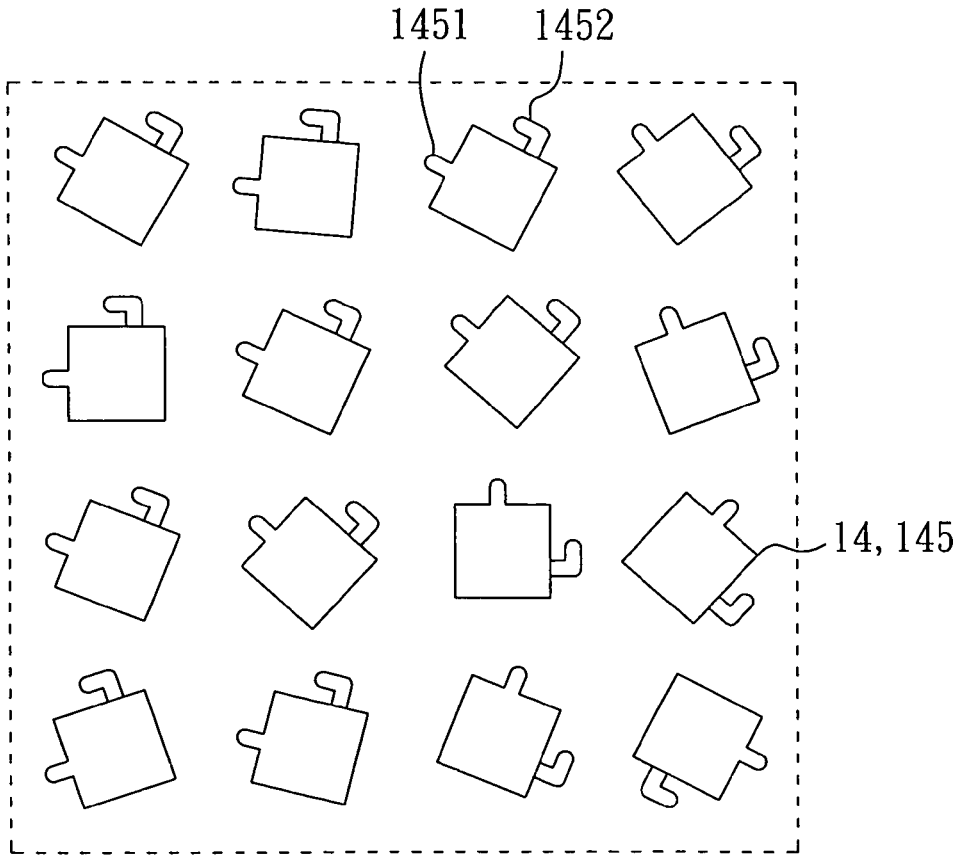
FIG. 3(PRIOR ART)
FIG. 3 is a schematic drawing of another plurality of array elements.
Figure 4:
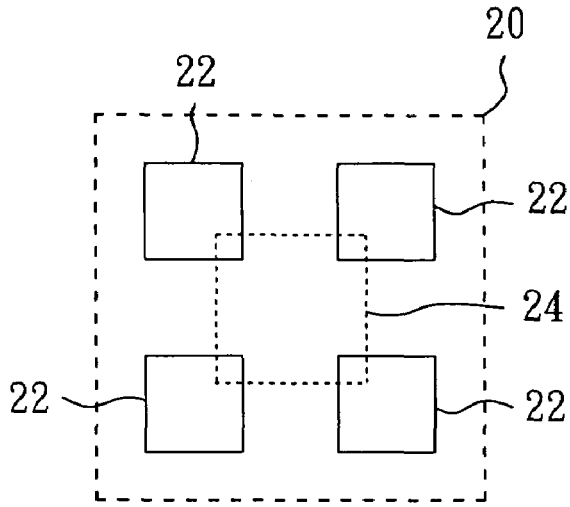
FIG. 4 is a front view of a plurality of array blocks of the present invention.

Please refer to FIG. 4. FIG. 4 is a front view of a plurality of array blocks of the present invention. The stacked microstrip reflect array antenna is different from the prior art reflect array antenna 10 in that a first platform (the platform facing the horn 16) of the circular disk 12 includes a plurality of array blocks 20 instead of a plurality of prior art array elements 14, and four array elements 22 of each array block 20 is mounted on the top surface of the first platform. One array element 24 of each array block 20 is mounted on a bottom surface of the first platform, and the array element 24 is placed at a position corresponding to a center of the four array elements 22, which couples a communication signal to the four array elements 22. With the different structure, the array blocks 20 can provide a wider bandwidth than the prior art array elements 14. Furthermore, a second platform (not shown) on the opposite side of the circular disk is a metal layer. The four array elements 22 of every array block 20 are rectangular metal sheets with identical shapes, and the edge length is related to a wave length of the communication signal; for example, the edge length is a half or quarter the wave length of the communication signal. If the operating frequency of the communications signal is 8 GHz to 10 GHz, the edge length of the rectangular metal sheets can be 4 mm to 5.2 mm, and a distance between the array elements 22 can be 3 mm. The array element 24 is also a rectangular metal sheet, and its edge length is also related to the wave length of the communications signal; for example, the edge length is a half or quarter wave length of the communications signal. If the operating frequency of the communications signal is 8 GHz to 10 GHz, the edge length of the rectangular metal sheets can be 5.2 mm to 5.7 mm. However, the edge length of the array element 22 and the array element 24 can be adjusted according to requirements.

Figure 5:
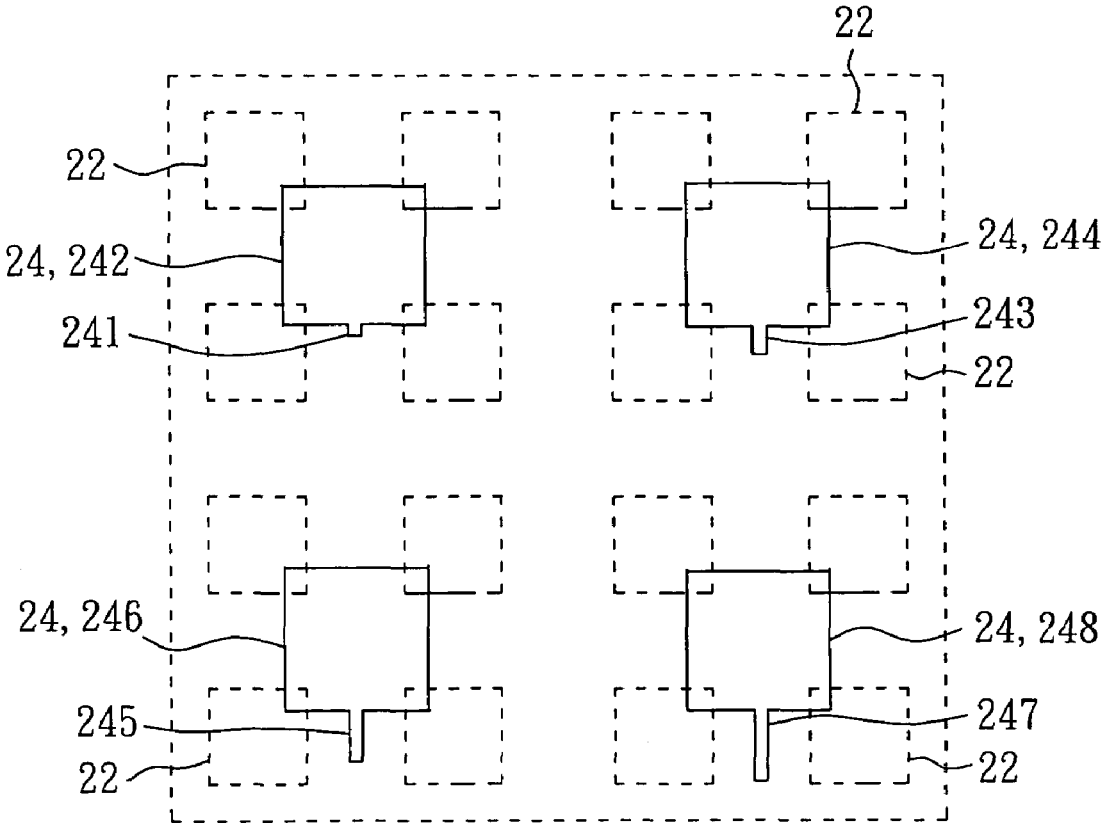
FIG. 5 is a back view of a plurality of array blocks of the present invention.

The array element 24 can include a plurality of delay lines to adjust the quality of the communication signal for better signal gain and a wider bandwidth. Please refer to FIG. 5. FIG. 5 is a back view of the plurality of array blocks of the present invention. The array elements 242, 244, 246 and 248 are connected to the delay lines 241, 243, 245 and 247. The delay lines 241, 243, 245 and 247 are rectangular metal sheets. Since a distance between the array elements 242, 244, 246 and 248 is larger than the distance between the array elements 22 or the array elements 14, the length of the delay lines 241, 243, 245 and 247 have fewer limitations and no needs for curved delay lines, which can reduce the complexity of the design and the amount of cross-polarization. Because the first array element 22 needs no delay line, and only the array elements 242, 244, 246 and 248 need the delay lines 241, 243, 245 and 247, the total number of delay lines of the present invention is a quarter of the total number of delay lines of the prior art reflect array antenna 10.

Figure 6:
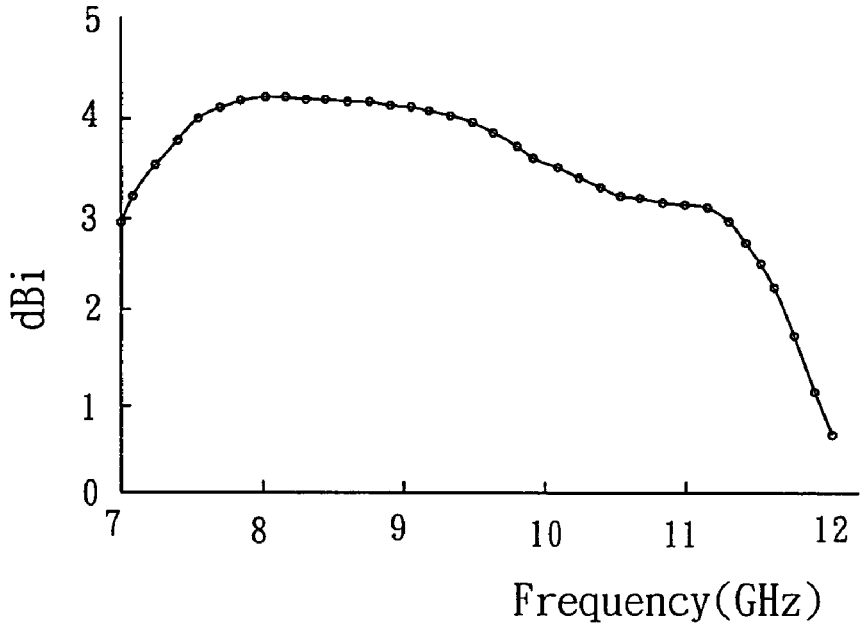
FIG. 6 is a waveform diagram of simulating a gain value of a stacked microstrip reflect array antenna of the present invention.
Figure 7:
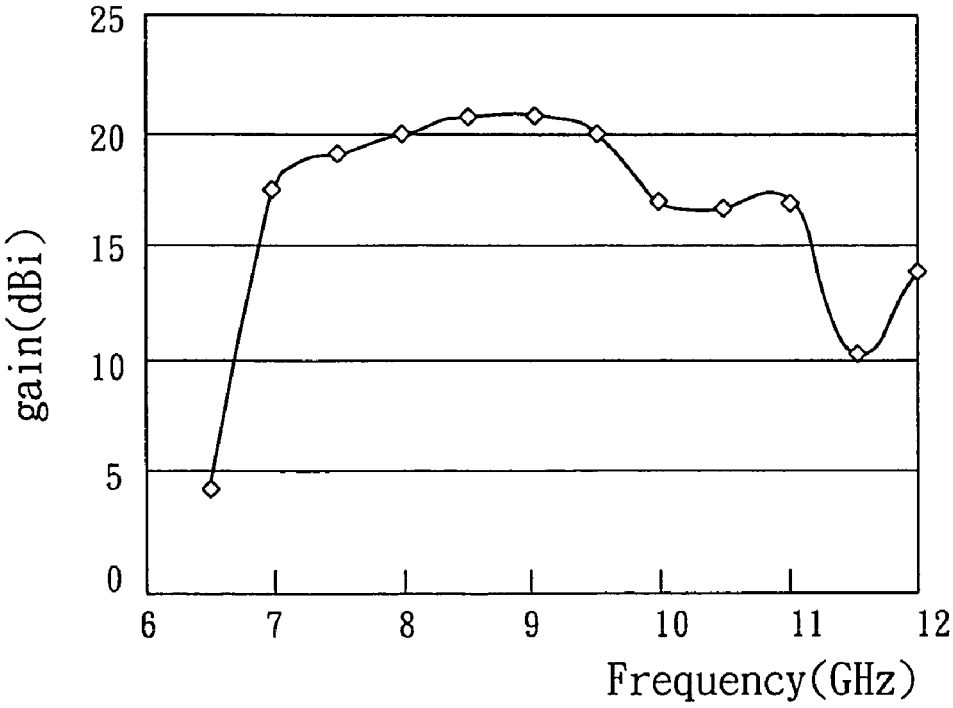
FIG. 7 is a waveform diagram of measuring a gain value of the stacked microstrip reflect array antenna of the present invention.
Figure 8:
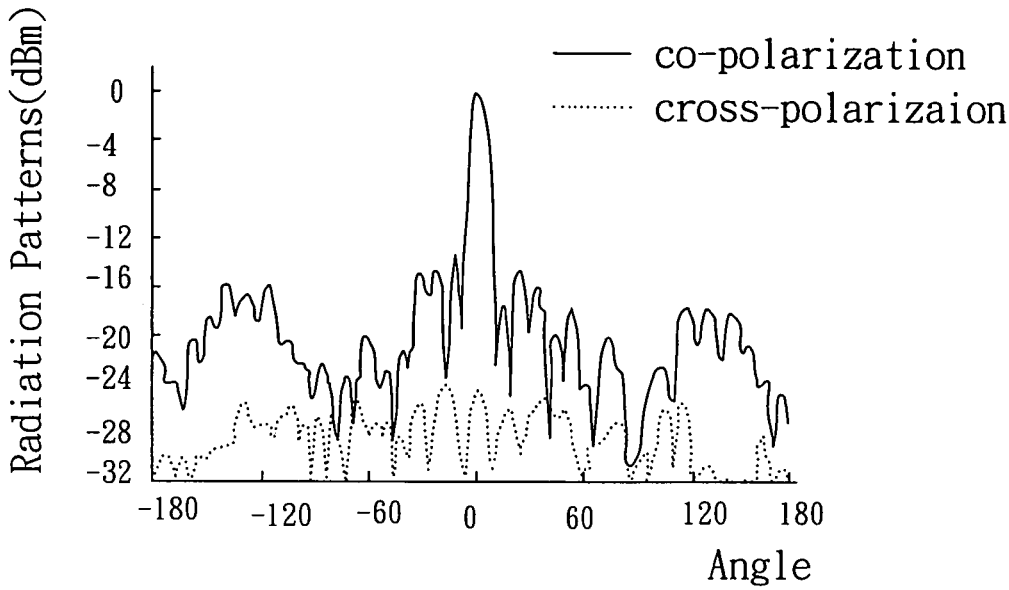
FIG. 8 is a waveform diagram of measuring a signal characteristic of the stacked microstrip reflect array antenna of the present invention.
Figure 9:
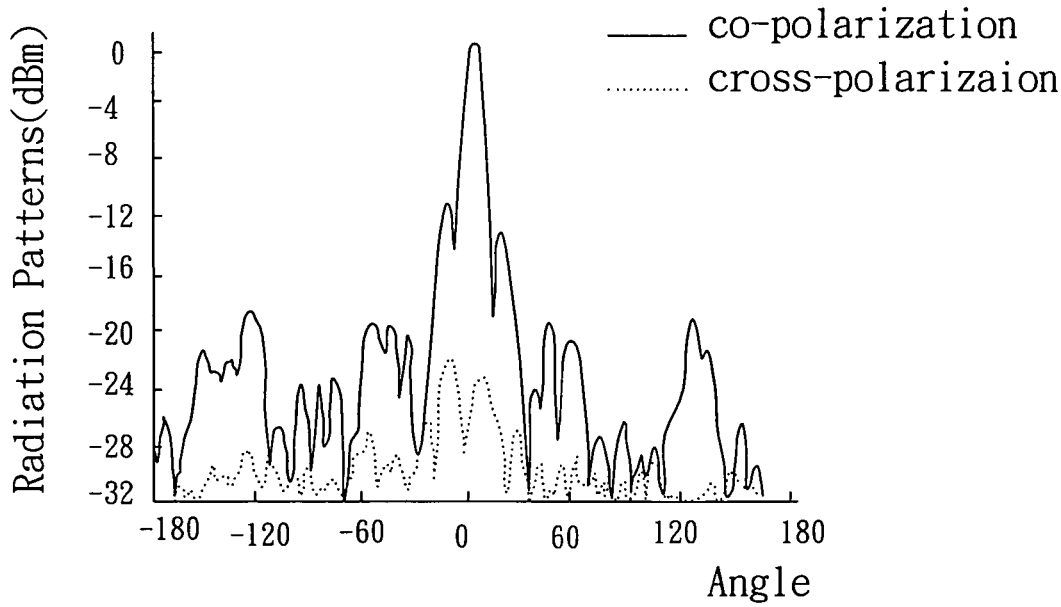
FIG. 9 is a waveform diagram of measuring a signal characteristic of the stacked microstrip reflect array antenna of the present invention.

The array block 20 is the basic structure for the stacked microstrip reflect array antenna of the present invention; therefore, analyzing a single array block 20 is very helpful when considering the stacked microstrip reflect array antenna of the present invention. Please refer to FIG. 6 and FIG. 7. FIG. 6 is a waveform diagram of simulating the gain value of a stacked microstrip reflect array antenna of the present invention. FIG. 7 is a waveform diagram of measuring a gain value of the whole stacked microstrip reflect array antenna of the present invention. Using an exciting microstrip line to perform a computer simulation calculation to the array block 20, the stacked microstrip reflect array antenna of the present invention has an operating frequency between about 8 GHz to 10 GHz and it has a flat gain response within this frequency range. The measured gain value of the whole stacked microstrip reflect array antenna of the present invention is shown in FIG. 7. The measured result confirms that a 1.5-db gain bandwidth of 17% can be achieved. Please refer to FIG. 8. FIG. 8 is a waveform diagram of measuring a signal characteristic of the stacked microstrip reflect array antenna of the present invention. When the operating frequency of the stacked microstrip reflect array antenna of the present invention is about 8 GHz, a phase of the communication signal is at a 0 deviation angle, and a difference between the co-polarization and the cross-polarization is above 25 db, which satisfies the needs of users. Please refer to FIG. 9. FIG. 9 is a waveform diagram measuring a signal characteristic of the stacked microstrip reflect array antenna of the present invention. When the operating frequency of the stacked microstrip reflect array antenna of the present invention is about 9 GHz, a phase of the communication signal is at a 0 deviation angle, and a difference between the co-polarization and the cross-polarization is above 25 db, which satisfies the needs of users.

Although the present invention has been explained in relation to its preferred embodiment, it is to be understood that many other possible modifications and variations can be made without departing from the spirit and scope of the invention as hereinafter claimed.

What is claimed is:

1. A stacked microstrip reflect array antenna comprising:

a circular disk for reflecting a remote communication signal;

an antenna for receiving the communication signal reflected by the circular disk and sending another communication signal to the circular disk to be reflected; and a fixing frame for fixing the antenna on a first platform of the circular disk; wherein the first platform comprises a plurality of array blocks, each array block comprises a plurality of first array elements and a second array element, the second array element having a delay line, the plurality of first array elements being mounted on a top surface of the first platform and the second array element being mounted on a bottom surface of the first platform at a position corresponding to a center of the plurality of first array elements.

2. The stacked microstrip reflect array antenna claimed in claim 1, wherein a second platform on the opposite side of the circular disk is a metal layer.

3. The stacked microstrip reflect array antenna claimed in claim 1, wherein the antenna is a horn antenna.

4. The stacked microstrip reflect array antenna claimed in claim 1, wherein the plurality of first array elements are rectangular metal sheets.

5. The stacked microstrip reflect array antenna claimed in claim 1, wherein an edge length of every first array element is half a wave length of the communication signal.

6. The stacked microstrip reflect array antenna claimed in claim 1, wherein the second array element is a rectangular metal sheet.

7. The stacked micro strip reflect array antenna claimed in claim 1, wherein an edge length of the second array element is half a wave length of the communication signal.

8. The stacked microstrip reflect array antenna claimed in claim 1, wherein the second array element is a rectangular metal sheet having a dimension about the same as a dimension of the first array elements.

9. The stacked microstrip reflect array antenna claimed in claim 1, wherein a length of the delay line is between quarter and half a wave length of the communication signal.

10. The stacked microstrip reflect array antenna claimed in claim 1, wherein said first array elements and said second array element each have an edge length related to a wave length of said communication signal.

* * * * *